US007559457B2

(12) United States Patent
Webber

(10) Patent No.: US 7,559,457 B2
(45) Date of Patent: Jul. 14, 2009

(54) MAILBOX ARRANGEMENT FOR WITHDRAWN IMPACTS FROM SNOW, SLUSH, ICE AND WATER THROWN FROM A PLOWBLADE

(75) Inventor: Michael Webber, 2 Chapel Hill Rd., Sherman, CT (US) 06784

(73) Assignee: Michael Webber, Sherman, CT (US)

( * ) Notice: Subject to any disclaimer, the term of this patent is extended or adjusted under 35 U.S.C. 154(b) by 0 days.

(21) Appl. No.: 11/903,357

(22) Filed: Sep. 20, 2007

(65) Prior Publication Data

US 2008/0149697 A1 Jun. 26, 2008

(51) Int. Cl.
*A47G 29/12* (2006.01)

(52) U.S. Cl. ..... 232/39; 248/131; 248/145; 248/417

(58) Field of Classification Search ..... 232/39; 248/131, 417, 125.7, 418, 145, 219.2; D99/32
See application file for complete search history.

(56) References Cited

U.S. PATENT DOCUMENTS

| | | | |
|---|---|---|---|
| 1,053,082 | A | 2/1913 | Yeakel |
| 1,273,696 | A | 7/1918 | Vanhoof |
| 2,522,983 | A | 9/1950 | Bergstrom |
| 2,605,073 | A | 7/1952 | Glenn |
| 2,683,013 | A | 7/1954 | Amundson |
| 3,243,104 | A | 3/1966 | Fillion |
| 3,407,997 | A | 10/1968 | Wood et al. |
| 3,899,150 | A | 8/1975 | Racquet |
| 4,113,213 | A | 9/1978 | Gay et al. |
| 4,130,239 | A | 12/1978 | Belsheim |
| 4,187,978 | A | 2/1980 | Dowker |
| 4,955,533 | A | 9/1990 | Merkel |
| 4,995,576 | A | 2/1991 | Kieswetter |
| 5,065,975 | A | 11/1991 | Giles |
| 5,215,283 | A | 6/1993 | Gould |
| 5,400,958 | A | 3/1995 | Walker |
| 5,437,409 | A | 8/1995 | Coushaine |
| 5,458,286 | A | 10/1995 | Paschal |
| 5,460,326 | A | 10/1995 | Albanesius |
| 5,524,853 | A | 6/1996 | Varlaro |
| 5,622,343 | A | 4/1997 | Morton |
| 5,699,989 | A | 12/1997 | Guthrie |

(Continued)

*Primary Examiner*—William L. Miller

(57) ABSTRACT

A mailbox arrangement is provided for mounting a mailbox to a mounting post, featuring a mailbox for receiving mail; a mounting base coupled to the mailbox; a mounting bracket for suitably coupling the mailbox arrangement to a mounting post; and a spring assembly for flexibly and rotationally coupling the mounting base to the mounting bracket in a predetermined relationship, the spring assembly being responsive to a force, for pivoting the mounting base in relation to the mounting bracket in one direction so as to resist and absorb a torque being applied as a result of the force, and for pivoting the mounting base in relation to the mounting bracket in the opposite direction as a result of the torque being stored in the spring assembly so as to return the mounting base and the mounting bracket back to the predetermined relationship when the force is no longer applied, so that when the mailbox is mounted on the mounting post, the mailbox is oriented in a desired position for receiving mail, and so that when the mailbox receives an impact from snow, slush, ice or water thrown from a plowblade as a street is being cleaned in the winter time, or an alternative impact from a vandal striking the mailbox, the mailbox itself will return to the desired position for receiving mail when the impact is no longer applied.

12 Claims, 11 Drawing Sheets

U.S. PATENT DOCUMENTS 5,779,202 A 7/1998 Black et al.
7,032,811 B1 4/2006 Paulic et al.
7,195,146 B1 * 3/2007 Dunn et al. ..... 232/39
7,249,704 B1 * 7/2007 Smith et al. ..... 232/39
2004/0228677 A1 11/2004 Henriques

* cited by examiner

MAILBOX ARRANGEMENT FOR WITHDRAWN IMPACTS FROM SNOW, SLUSH, ICE AND WATER THROWN FROM A PLOWBLADE

CROSS REFERENCE TO RELATED APPLICATIONS

This application claims benefit to patent application Ser. No. 11/523,786, filed 18 Sep. 2006, now abandoned, which is hereby incorporated by reference in its entirety.

BACKGROUND OF THE INVENTION

1. Field of Invention

This invention relates to mailboxes, and more particularly to a mailbox that is designed to withstand the impact from snow, slush, ice and water thrown from a plowblade when streets are being cleaned in the winter time, as well as impact from vandalism.

2. Description of Related Art and Comments Re Comparison the Invention

Below are comparisons and opinions to some mailbox patents found in a patentability search for the spin post and protective shield:

Webber Vs. Gay

The Post

GAY: The Gay design has a vertical square post. This has been proven through the years to be much more vulnerable than the round type post, especially on a slant. The wood post into a concrete footing is a permanent but temporary installation, the wood would eventually rot and there would be no way to adjust it. In addition, the patent clearly specifies that this support post must be perfectly vertical for the device to function properly.

Invention: The round angled stainless steel post is much less vulnerable to a hit and would last approximately fifty years. With the easy install anchoring system, one can adjust by loosening the three base nuts and shimming it with ordinary washers.

The Box to Post

GAY: The clamp on post design is also very temporary, when the wood shrinks the clamps will loosen. The clamping U-bolts would need to be a non-corrosive type material allowing periodic tightening. This would also make this mailbox easy to steal.

Invention: The spin post shield and box holder is a formed three sixteenth inch stainless steel, welded and fastened with a half inch diameter nut and bolt through the bearing, making this part much more durable.

The Mail Box Support Arm

GAY: This portion has many parts mostly for extending the box towards the street and allowing adjustments just by a few inches. The shear pin bolts seem to be light duty. There would need to be an access hole to the pin nearest the bearing allowing moisture into the bearing eventually seizing. The bell shape space around the bearing could also be a potential home for bees.

Invention: This portion has one part, the mounting base and shield. This very ridged piece connects and protects the side and underside of the box, fastened as described above.

The Swing Concept

GAY: This design allows the box to swing when hit and returns to it's original position. However, it only rotates on the same side of the post spinning upside down. The Gay design keeps the box in the most vulnerable position for damage. The unprotected mailbox would most likely be just as damaged as a fixed type box. If the door could not be closed or if it were left open the angle the box turns, moves the door into a tear off position. The combination of area with the extended support arm would transfer back to the wood post that must remain "perfectly vertical".

Invention: The spin post design allows the box to spin three hundred and sixty degrees around the post and as far out of the way as possible. The initial force pushes the box away exposing the least amount of area (the back side).

The invention provides a very strong frame from the ground up and reduces all the pressure points as much as possible.

Webber Vs. Black

Overall

BLACK: This design does not return to it's original position and is as temporary as any vertical wooden post. If it were pushed out of plumb then the box would face that direction. The post and box holder has much more area receiving the pressure. Ice would form on the flat horizontal and the vertical post area preventing any pivoting at all. This design should does even compare to the present invention.

BRIEF DESCRIPTION OF THE DRAWING

The drawing, which is not drawn to scale, includes the following Figures

FIG. 1, including FIGS. 1*a*, 1*b* and 1*c*, provides a formal rendering of the mailbox according to the invention, where

FIG. 8, including FIGS. 8*a*, 8*b*, 8*c* and 8*d*, provides a formal rendering of the mailbox according to the invention, where

BRIEF SUMMARY OF THE INVENTION

Figure 1A:
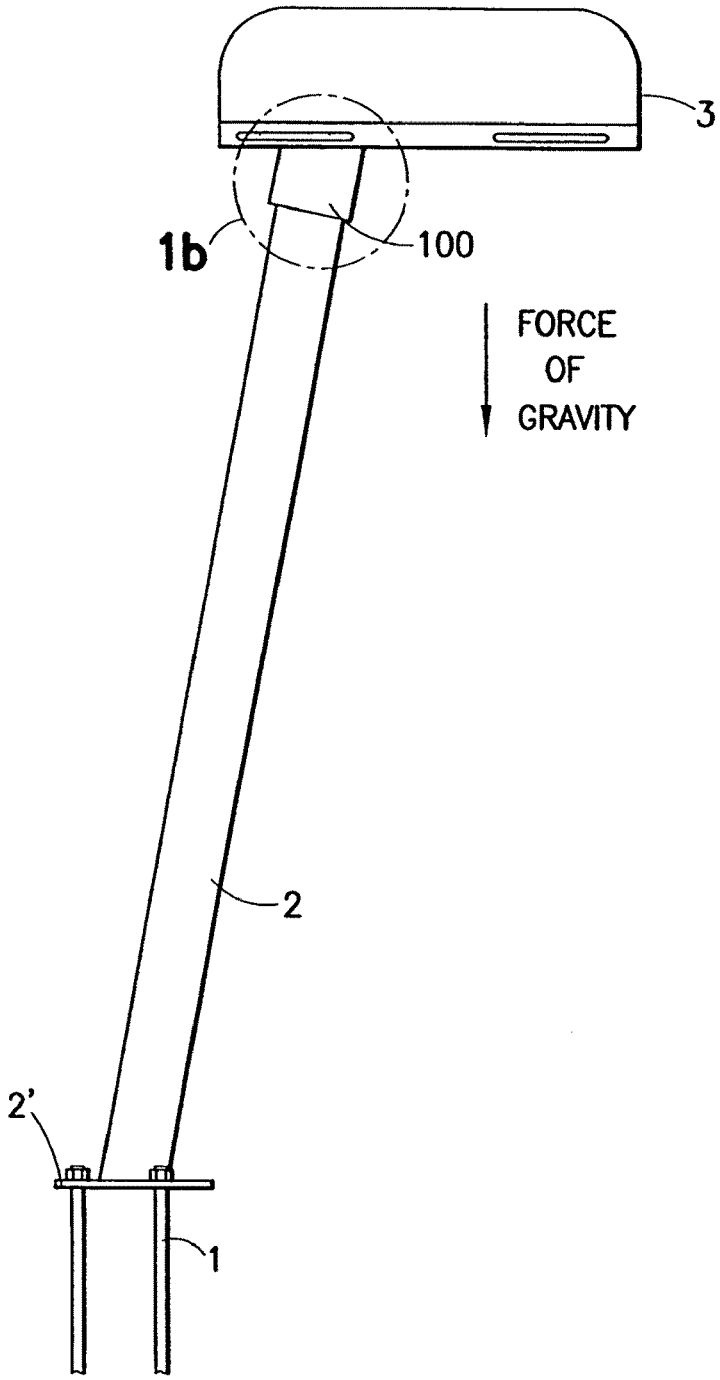
FIG. 1*a* shows a side view of the mailbox according to the present invention; where

The present invention features a new and unique mailbox arrangement for mounting a mailbox to a mounting post, featuring a mailbox for receiving mail; a mounting base coupled to the mailbox; a mounting bracket for suitably coupling the mailbox arrangement to a mounting post; and a spring assembly for flexibly and rotationally coupling the mounting base to the mounting bracket in a predetermined relationship, the spring assembly being responsive to a force, for pivoting the mounting base in relation to the mounting bracket in one direction so as to resist and absorb a torque being applied as a result of the force, and for pivoting the mounting base in relation to the mounting bracket in the opposite direction as a result of the torque being stored in the spring assembly so as to return the mounting base and the mounting bracket back to the predetermined relationship when the force is no longer applied, so that when the mailbox is mounted on the mounting post, the mailbox is oriented in a desired position for receiving mail, and so that when the mailbox receives an impact from snow, slush, ice or water thrown from a plowblade as a street is being cleaned in the winter time, or an alternative impact from a vandal striking the mailbox, the mailbox itself will return to the desired position for receiving mail when the impact is no longer applied.

The spring assembly may include a torsion spring, although the scope of the invention is intended to include other types or kind of resilient elements either now known or later developed in the future.

The mounting base may include a spring retainer for receiving one end of the torsion spring, and the mounting bracket may include a spring retainer for receiving another end of the torsion spring.

The spring assembly may include a dowel pin for fixedly coupling to the mounting bracket and a spacer for fixedly coupling to the mounting base and pivotally arranging on the dowel pin; and the torsion spring may be arranged on the spacer and has one end coupled to a spring retainer in the mounting base and another end coupled to a corresponding spring retainer in the mounting bracket. The spring assembly may include a thrust washer coupled to the dowel pin. The dowel pin may be welded to the mounting bracket and the spacer may be welded to the mounting base, although the scope of the invention is intended to include other types or kinds or ways of fastening such elements together either now known or later developed in the future.

The mounting base may include universal mailbox mounting slots for mounting the mailbox.

The mounting bracket may have one or more apertures for receiving screws for affixing the mounting the mounting bracket to the mounting post.

The mounting bracket may include a protective shield for protecting the mailbox.

The present invention may also take the form of a mailbox mounting arrangement for mounting a mailbox to a mounting post, featuring such a mounting base for suitably coupling the mailbox mounting arrangement to a mailbox; such a mounting bracket for suitably coupling the mailbox mounting arrangement to a mounting post; and such a resilient assembly for flexibly and rotationally coupling the mounting base to the mounting bracket in a predetermined relationship, the resilient assembly being responsive to a force, for pivoting the mounting base in relation to the mounting bracket in one direction so as to resist and absorb a torque being applied as a result of the force, and for pivoting the mounting base in relation to the mounting bracket in the opposite direction as a result of the torque being stored in the resilient assembly so as to return the mounting base and the mounting bracket back to the predetermined relationship when the force is no longer applied, so that when the mailbox is mounted on the mounting post, the mailbox is oriented in a desired position for receiving mail, and so that when the mailbox receives an impact from snow, slush, ice or water thrown from a plowblade as a street is being cleaned in the winter time, or an alternative impact from a vandal striking the mailbox, the mailbox itself will return to the desired position for receiving mail when the impact is no longer applied.

Other embodiments may also include a mailbox arrangement featuring a mailbox; a pipe for coupling and/or affixing the mailbox to the ground in a desired position for receiving mail; and a swing bearing assembly arranged between the mailbox and the pipe on a slanted axis in relation to the axis of the force of gravity acting on the mailbox for rotating the mailbox 360 degrees or more in relation to the pipe in response to an impact, including that from snow, slush, ice or water thrown from a plowblade when streets are being cleaned in the winter time, as well as impact from vandalism, and for returning the mailbox to the desired position based on the force of gravity acting on the mailbox.

Embodiments include either the longitudinal axis of the pipe being arranged on the slanted or oblique axis in relation to the axis of the force of gravity and/or the plane of the ground, the plane of rotating of the swing bearing assembly being on such a slanted or oblique axis, or both.

For example, the pipe may be arranged at an angle of about 80 degrees in relation to the axis of the force of gravity and/or the plane of the ground, and also may include other angles in a range of, for example, about 60-85; and the plane of rotating $P_R$ of the swing bearing assembly may be perpendicular or oblique to the longitudinal axis or circumferential plane of the pipe.

Alternatively, the pipe may be arranged at an angle of about 90 degrees in relation to the plane of the ground, and the plane of rotating $P_R$ of the swing bearing assembly may be oblique to the longitudinal axis or circumferential plane of the pipe. Similar to the first embodiment, the plane of rotating $P_R$ of the swing bearing assembly may be arranged at an angle of about 80 degrees, or possibly in a range of about 60-85 degrees, in relation to the longitudinal axis or circumferential plane of the pipe.

The swing bearing assembly may take the form of a flange bearing or a wheel bearing.

The swing bearing assembly may be weatherproof protected by arranging it inside a collar of the mailbox.

The mailbox may also have a protective shield.

The present invention also provides a mailbox assembly for coupling to such a pipe or other suitable structure featuring such a mailbox in combination with such a swing bearing assembly suitably adapted in either of the ways discussed above for arranging on such a slanted axis on such a pipe.

Furthermore, the present invention also provides a mailbox assembly comprising: a mailbox; a pipe for coupling and/or affixing the mailbox to the ground; and a spring assembly arranged between the mailbox and the pipe for providing resiliency to the mailbox in response to a force intended to vandalize the mailbox. The spring assembly includes a spring coupled in relation to a bottom plate and a bolt or rod arranged in and coupled to the pipe, as well as a universal flex joint assembly for coupling to the mailbox. The universal flex joint assembly is coupled to the bolt or rod.

BEST MODE OF THE INVENTION

FIGS. 1-4*b*: The Spin Post Mailbox Design

Figure 1C:
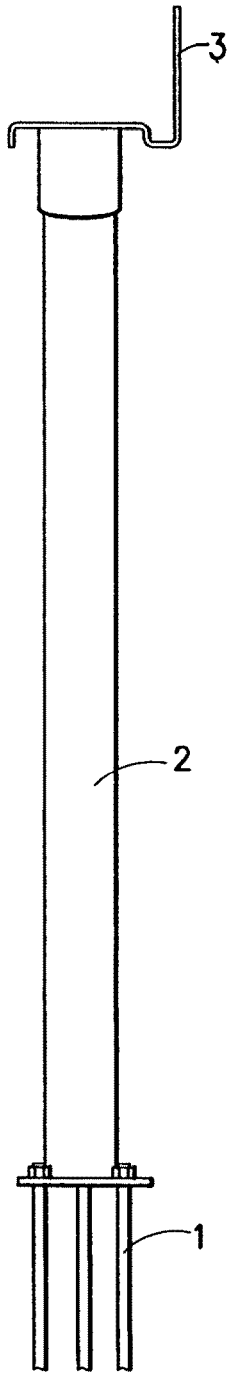
FIG. 1*c* shows a back view of the mailbox shown in FIG. 1*a* according to the present invention.

FIGS. 1-4*b* show a new and unique spin post mailbox design according to the present invention. As shown in FIG. 1, the present invention provides a mailbox arrangement featuring, in combination, the mailbox 3; a pipe 2 for coupling and/or affixing the mailbox 3 to the ground in a desired position for receiving mail, and a swing bearing assembly 100 for coupling the mailbox 3 to the pipe 2. The swing bearing assembly is arranged between the mailbox 3 and the pipe 2 so that its plane of rotating $P_R$ is on a slanted axis in relation to the axis of the force of gravity acting on the mailbox 3 for rotating the mailbox 360 degrees or more in relation to the pipe in response to an impact, including that from snow, slush, ice or water thrown from a plowblade (not shown) when streets are being cleaned in the winter time, as well as impact from vandalism, and for returning the mailbox to the desired position based on the force of gravity acting on the mailbox. Embodiments are envisioned and the scope of the invention is intended to include either the longitudinal axis of the pipe 2 being arranged on the slanted or oblique axis in relation to the force of gravity acting on the mailbox and/or the plane of the ground, the plane of rotating of the swing bearing assembly 100 being on such a slanted or oblique axis, or both.

Figure 1B:
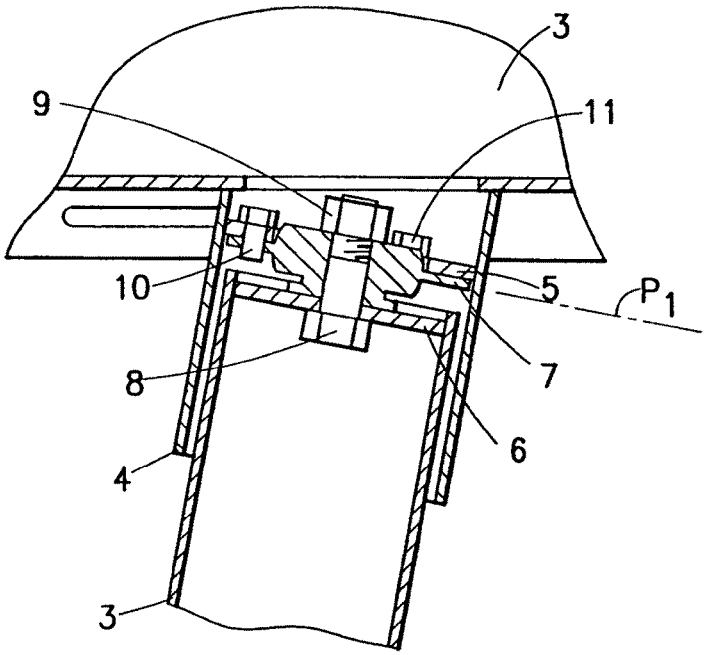
FIG. 1*b* shows a detailed view of the swing bearing assembly shown in FIG. 1*a* according to the present invention; and where
Figure 2A:
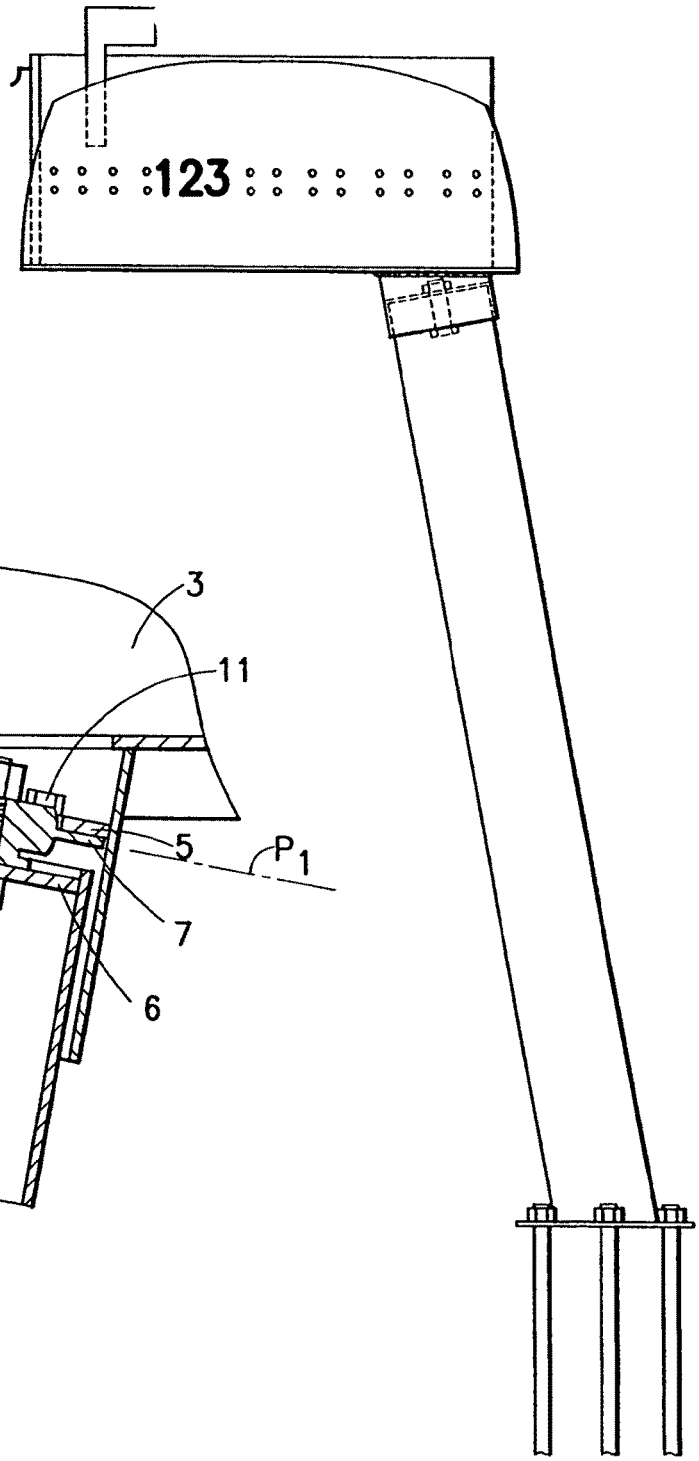
FIG. 2*a* shows a side view of the mailbox according to the present invention.
Figure 2C:
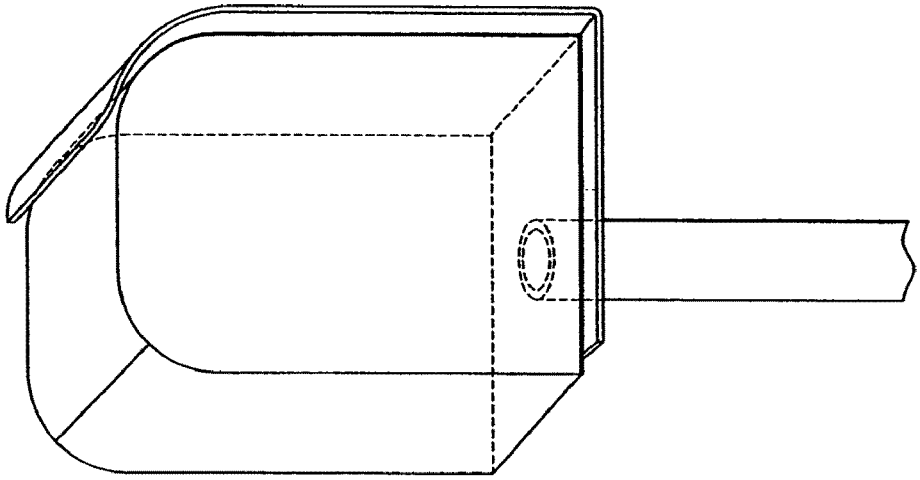
FIG. 2*c* shows a perspective view of the mailbox shown in FIG. 2*a* according to the present invention.
Figure 2B:
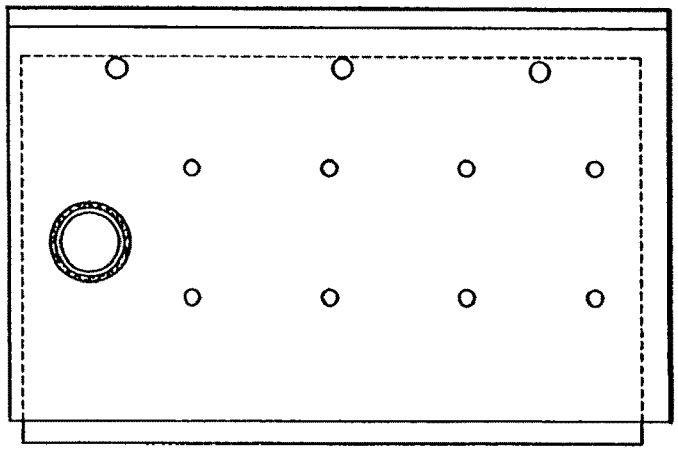
FIG. 2*b* shows a bottom view of the mailbox mounting base according to the present invention, consistent with that shown in FIG. 2*a*.

For example, as shown in FIG. 1*a*, by way of example, the pipe 2 may be arranged at an angle of about 80 degrees in relation to the plane of the ground, and the swing bearing assembly 100 best shown in FIG. 1*b* is arranged in the pipe 2 to rotate in relation to the angle of about 80 degree. Although the invention is described by way of example in relation to an angle of about 80 degrees, the scope of the invention is not intended to be limited to any particular angle between the post and the ground. For example, embodiments are envisioned in which the angle between the post and the ground is less than or more than 80 degrees, including angles in a range such as about 60 to 85 degrees.

FIG. 1*b* shows the swing bearing assembly 100 in further detail mounted or coupled between the mailbox 3 and the pipe 2, including a flange bearing mounting ring 5, a welded plate 6, a flange type ball bearing 7, a bolt 8 welded to plate 6, a lock nut 9 and retaining nuts and bolts 10. As shown, the flange bearing mounting ring 5 is coupled to a collar 4 that is coupled itself coupled to the mailbox mounting plate 3'. The welded plate 6 is coupled to the inside of the pipe 2. The flange type ball bearing 7 is coupled between the flange bearing mounting ring 5 and the welded mounting plate 6. As shown, the plane of rotating $P_R$ of the swing bearing assembly 100 is substantially perpendicular to the longitudinal axis or circumferential plane of the pipe 2.

Furthermore, the present invention may also include the pipe 2 being arranged at an angle of about 90 degrees (i.e. perpendicular) in relation to the axis of the force of gravity and/or the plane of the ground, and the swing bearing assembly 100 being arranged between the mailbox 3 and the pipe 2 on a slanted axis in relation to the axis of the force of gravity acting on the mailbox. In this case, the plane of rotating $P_R$ of the swing bearing assembly 100 is on the slanted or oblique axis in relation to the axis of force of gravity acting on the mailbox 3 for rotating the mailbox 360 degrees or more in relation to the pipe in response to the impact. Moreover, in this case, the plane of rotating $P_R$ of the swing bearing assembly 100 would be oblique to the longitudinal axis or circumferential plane of the pipe 2. Similar to the first embodiment, the plane of rotating $P_R$ of the swing bearing assembly 100 may be arranged at an angle of about 80 degrees, or possibly in a range of about 60-85 degrees.

By way of example, the flange type ball bearing 7 may be an off-the-shelf extended inner race ball bearing (flange-type) that is well known in the art. As a person skilled in the art would appreciate, it includes a housing or flange, an inner race, an outer race and ball bearings arranged in between.

Figure 3:
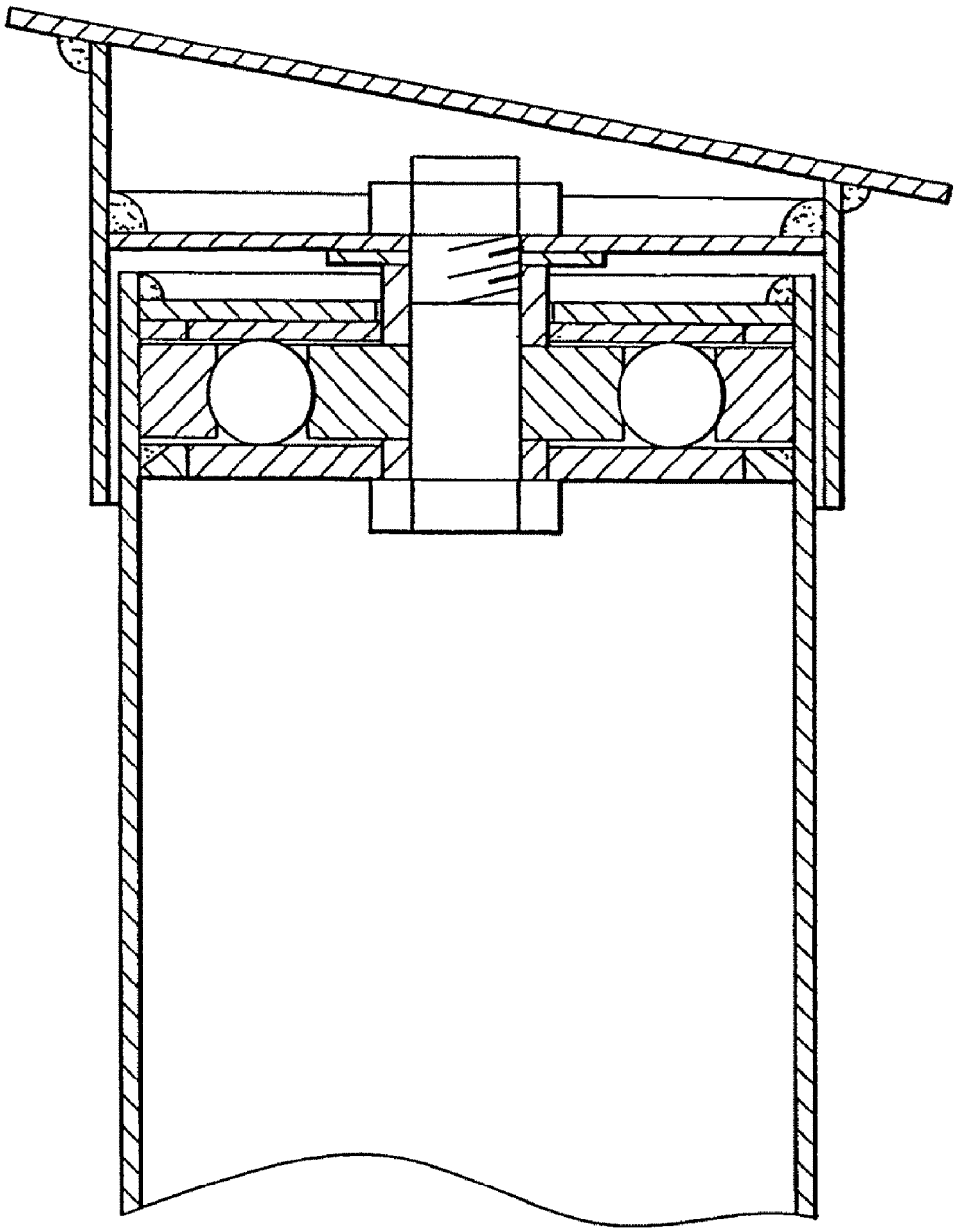
FIG. 3 shows a spin post and protective shell according to the present invention in the form of a weather protected ball bearing spin assembly.

As shown, the inner race may be fixedly arranged up against the welded plate 6 and pressed against it by the bolt 8, and the housing or flange may be fixedly coupled to the mounting ring 5. In operation, the outer race may be held by pressure to the housing or flange and allows the mailbox 3 to freely rotate 360 degrees or more in relation to the pipe 2 in response to the impact. Although the invention is shown and described in relation to a flange bearing, the scope of the invention is not intended to be limited to any particular type or kind of bearing. For example, FIG. 3 shows an alternative embodiment of the present invention in which a wheel type bearing (see element J) is used. Moreover, the scope of the invention is intended to include other type or kind of bearing either now known or later developed in the future.

As shown in FIG. 1*a*, the pipe 2 is mounted at the angle of about 80 degree to a pipe mounting plate 2' for coupling to the ground. By way of example, the pipe 2 may couple and/or affix the mailbox 3 to the ground in FIG. 1*a* using techniques set forth in FIGS. 4, 4*a* and 4*b*. Although the invention is shown and described in relation to such techniques in FIGS. 4, 4*a* and 4*b*, the scope of the invention is not intended to be limited to any particular type, kind or way of coupling the pipe to the ground. Moreover, the scope of the invention is intended to include other type, kind or ways of coupling the pipe 2 to the ground either now known or later developed in the future.

The swing bearing assembly 100 may also be weatherproof protected by being arranged inside the collar 4, as shown.

The mailbox 3 may also include an optional protective shield (see element B in Figure AC).

FIGS. 5*a*-7*e*: The Spring Back Mailbox Design

FIGS. 5*a*-7*e* show a spring back mailbox design which may be used alone or together with the invention set forth above. It provides a mailbox assembly comprising: a mailbox; a pipe for coupling and/or affixing the mailbox to the ground; and a spring assembly arranged between the mailbox and the pipe for providing resiliency to the mailbox in response to a force intended to vandalize the mailbox.

The spring assembly includes a spring coupled in relation to a bottom plate and a bolt or rod arranged in and coupled to the pipe, as well as a universal flex joint assembly for coupling to the mailbox. The universal flex joint assembly is coupled to the bolt or rod.

Figure 4:
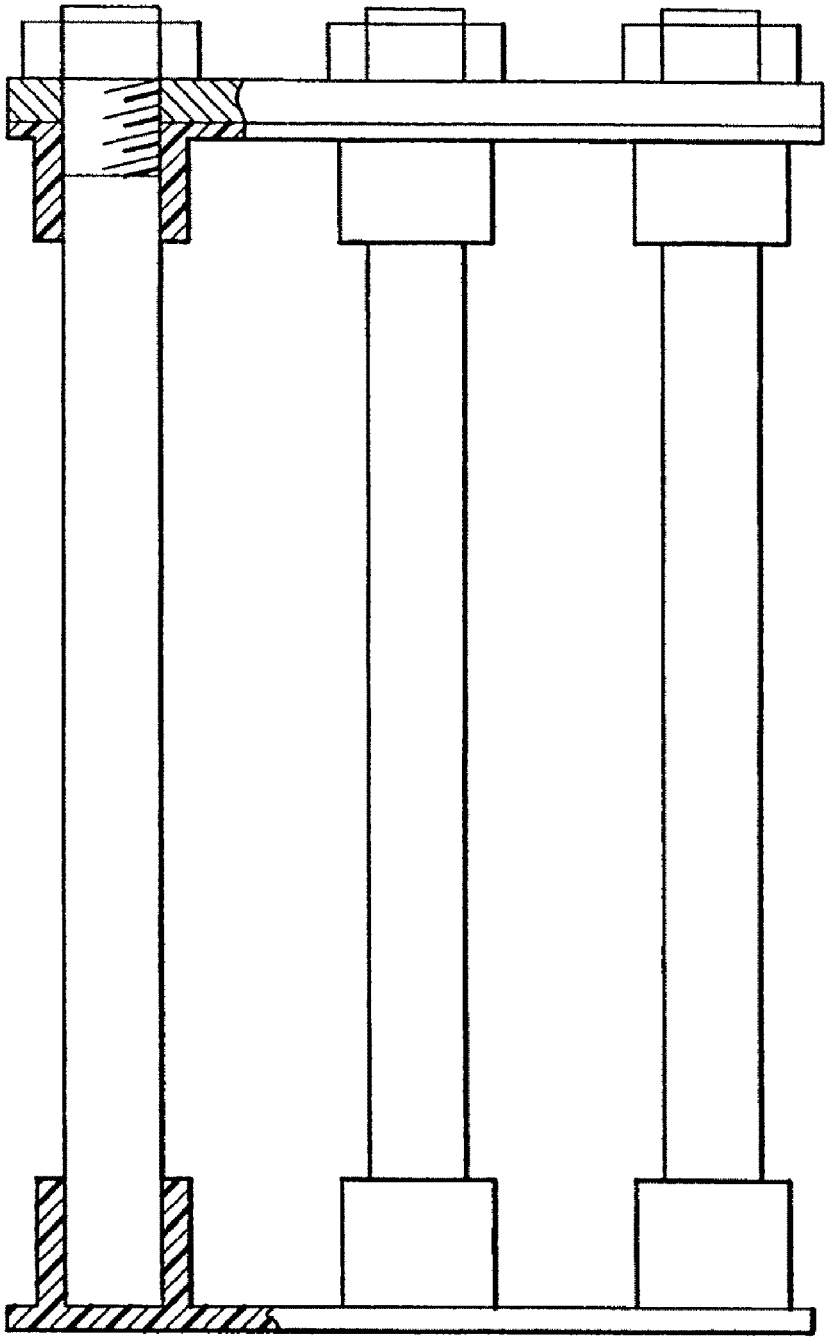
FIG. 4 shows an easy install anchoring base assembly according to the present invention.
Figure 4A:
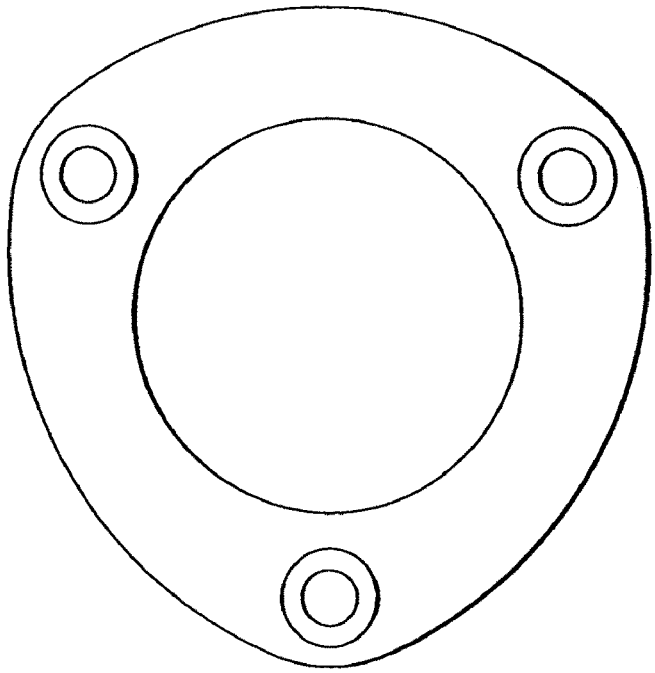
FIGS. 4*a* and 4*b* shows a post base assembly according to the present invention.
Figure 4B:
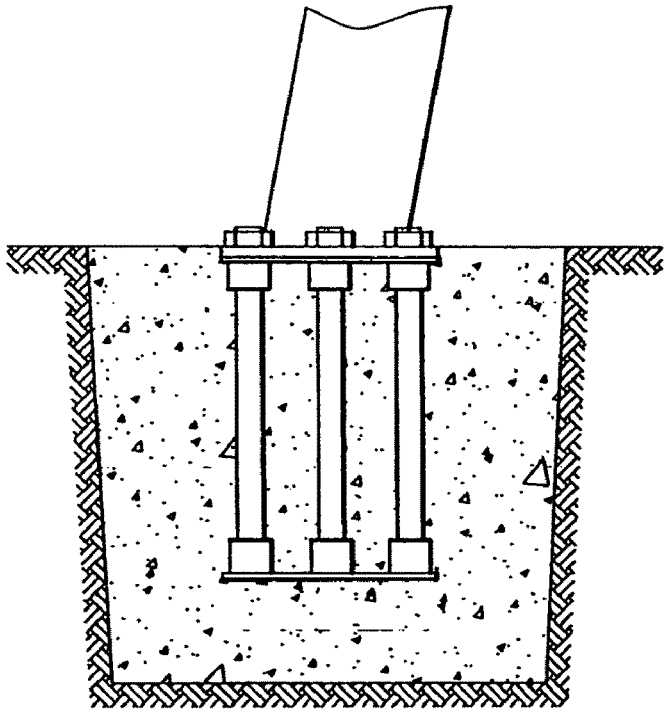
Figure 5A:
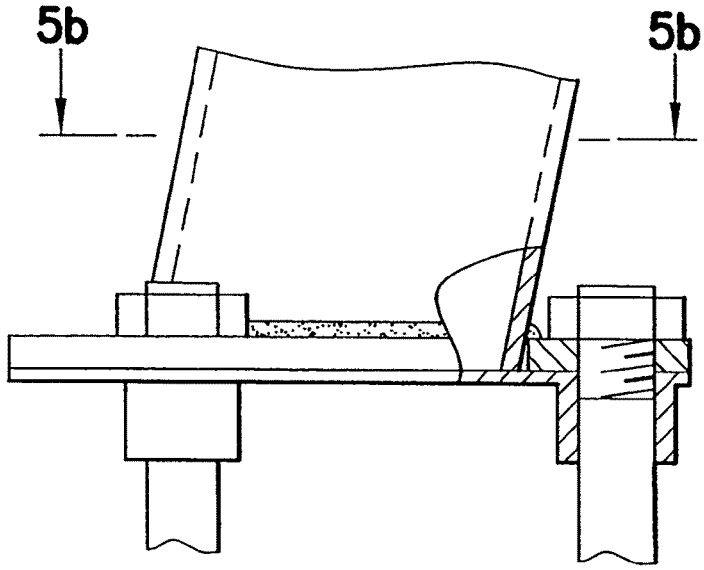
FIGS. 5*a* to 7*e* show an alternative embodiment of the present invention featuring a spring back post design which may be used alone or together with the invention set forth in FIGS. 1*a* to 4*b*.
Figure 5B:
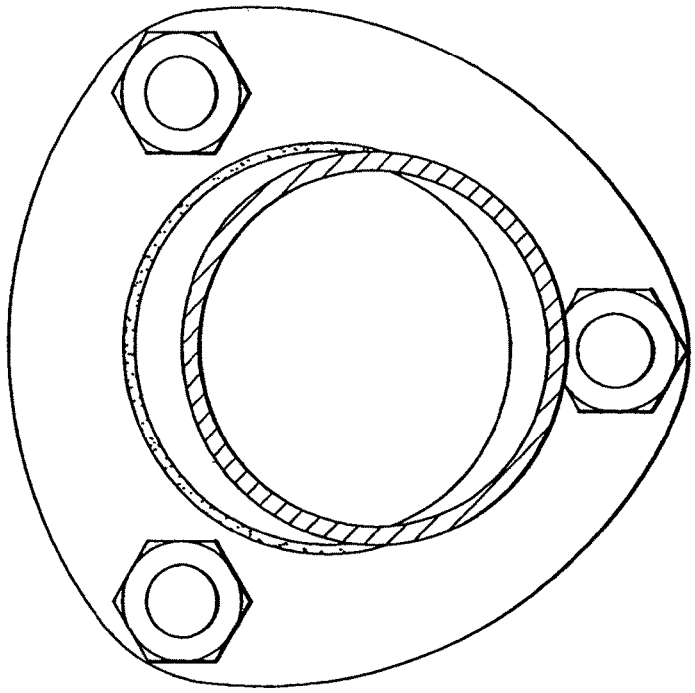
Figure 6:
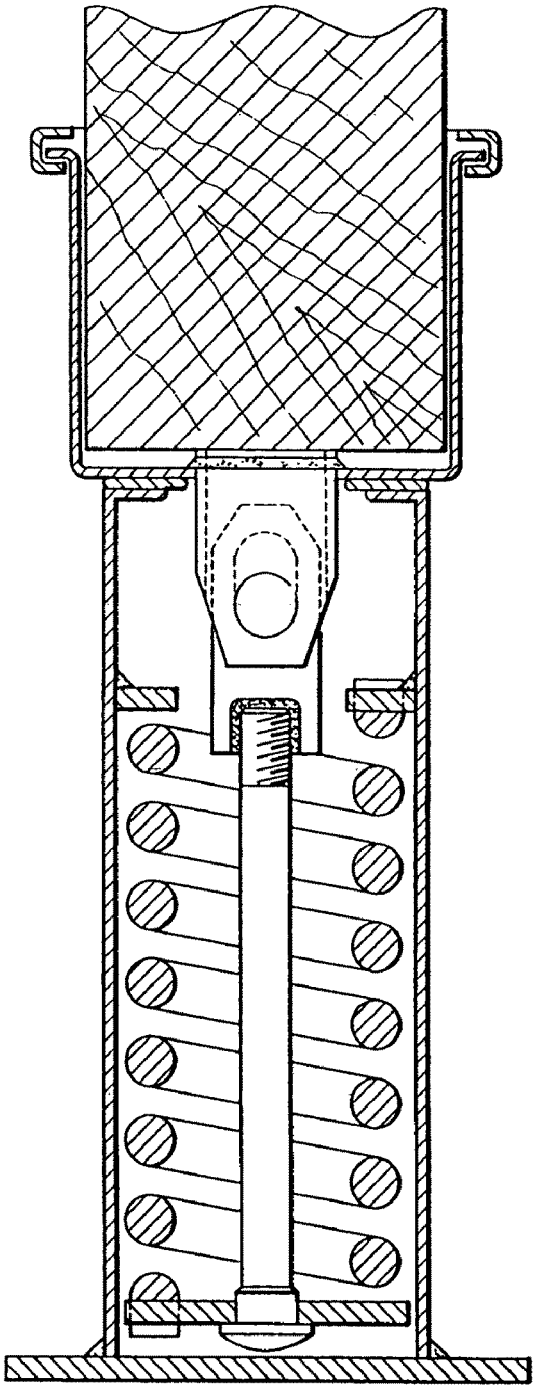
Figure 6A:
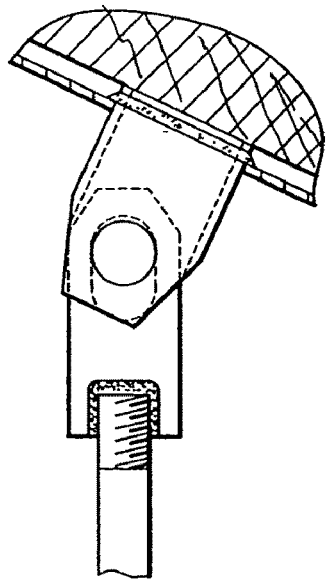
Figure 6B:
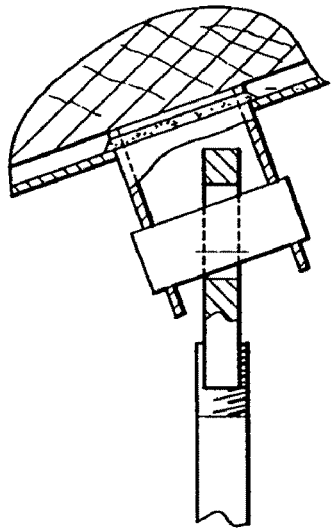
Figure 7A:
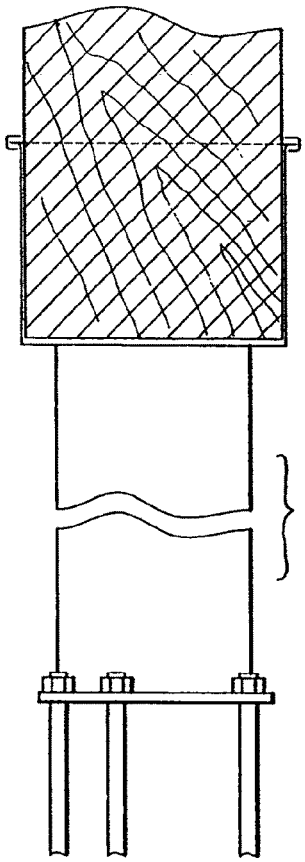
Figure 7C:
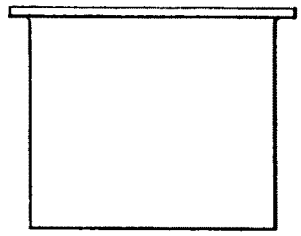
Figure 7D:
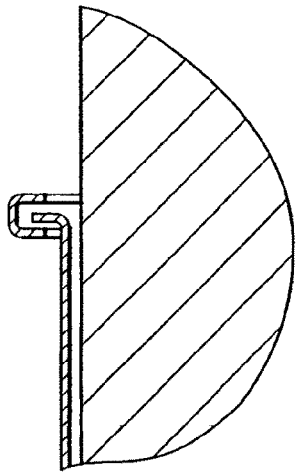
Figure 7B:
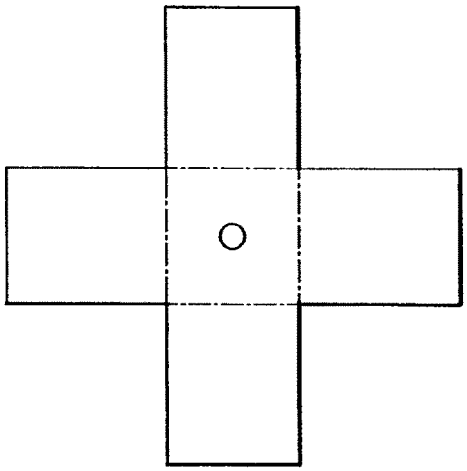
Figure 7E:
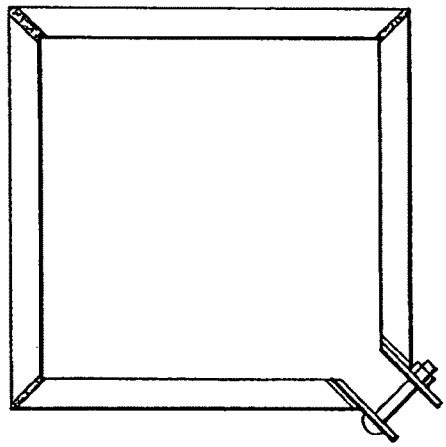

By way of example, the pipe may be couple and/or affixing the mailbox to the ground using the techniques set forth in FIGS. 4, 4*a* and 4*b*.

FIG. 8

Figure 8B:
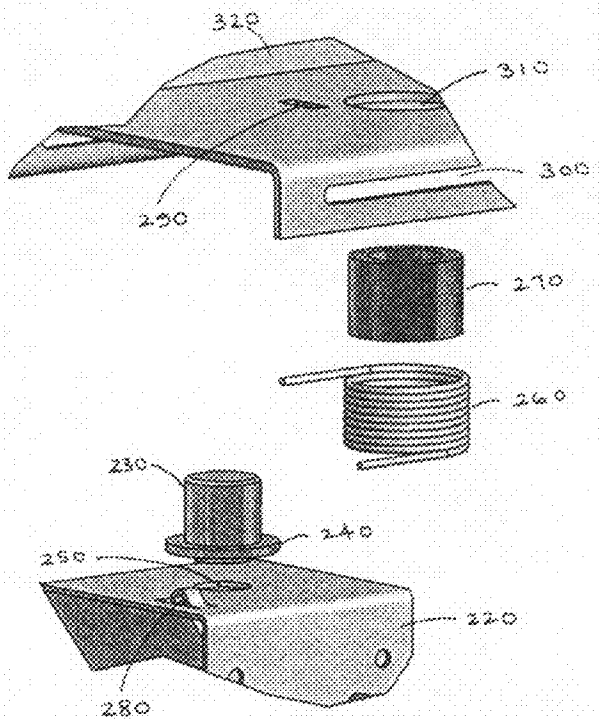
FIG. 8*b* shows a detailed perspective view of the spring assembly shown in FIG. 8*a* according to the present invention; where
Figure 8A:
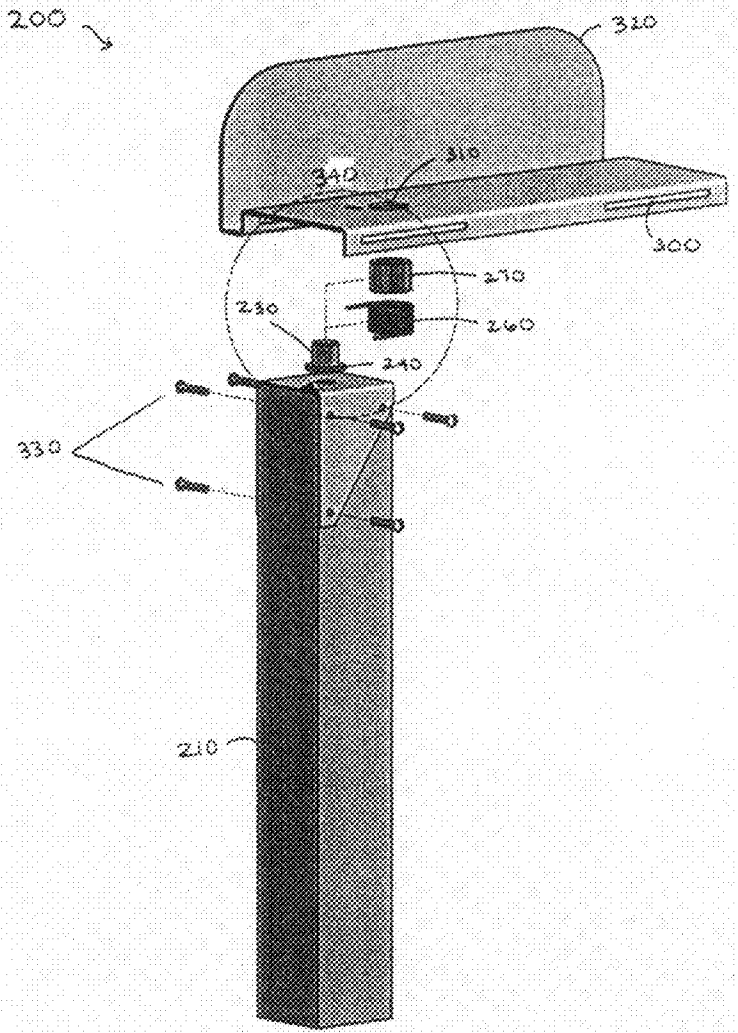
FIG. 8*a* shows a perspective view of the mailbox according to the present invention in a disassembled state; where
Figure 8D:
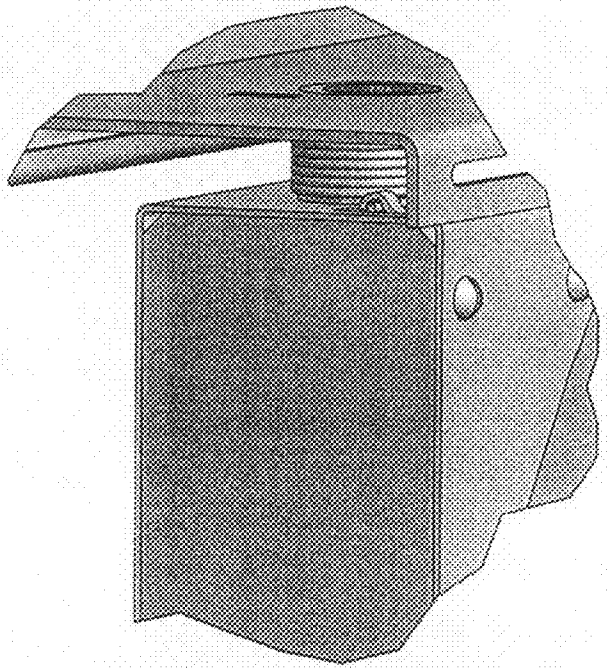
FIG. 8*d* shows a detailed perspective view of the spring assembly shown in FIG. 8*d*.

FIGS. 8*a*, 8*b*, 8*c* and 8*d* show a new and unique spring post mailbox design according to the present invention. As shown in FIG. 8*a*, the present invention provides a mailbox arrangement featuring, in combination, a mailbox (not shown), a 4×4 wood post 210 for coupling and/or affixing the mailbox to the ground in a desired position for receiving mail, and a resilient or spring assembly 340 for coupling the mailbox to the wood post 210. The spring assembly 340 is arranged between the mailbox and the wood post 210 for rotating the mailbox at some angle in relation to the wood post 210 for providing resiliency in response to an impact, including that from snow, slush, ice or water thrown from a plowblade (not shown) when streets are being cleaned in the winter time, as well as impact from vandalism, and for returning the mailbox to the desired position based on the torque of the spring assembly on the mailbox.

As shown in further detail in FIG. 8*b*, a ⅛" steel mounting bracket 220 is fixedly mounted to the 4×4 wood post 210 by means of wood type screws 330. A thrust washer 240 is coupled to a steel dowel pin 230, which is fixed by welding to area 250 of steel mounting bracket 220. A round steel spacer 270 is coupled to the steel dowel pin 230, and a torsion spring 260 is slid over the round steel spacer 270. The round steel spacer 270 is fixed by welding to area 310 of steel mailbox mounting base/protection shield 320. The torsion spring 260 is coupled to the steel mounting bracket 220 by sliding one end of the spring into spring retainer 280. The torsion spring 260 is further coupled to the steel mailbox mounting base/protection shield 320 by sliding the opposite end of the spring into spring retainer 290.

Figure 8C:
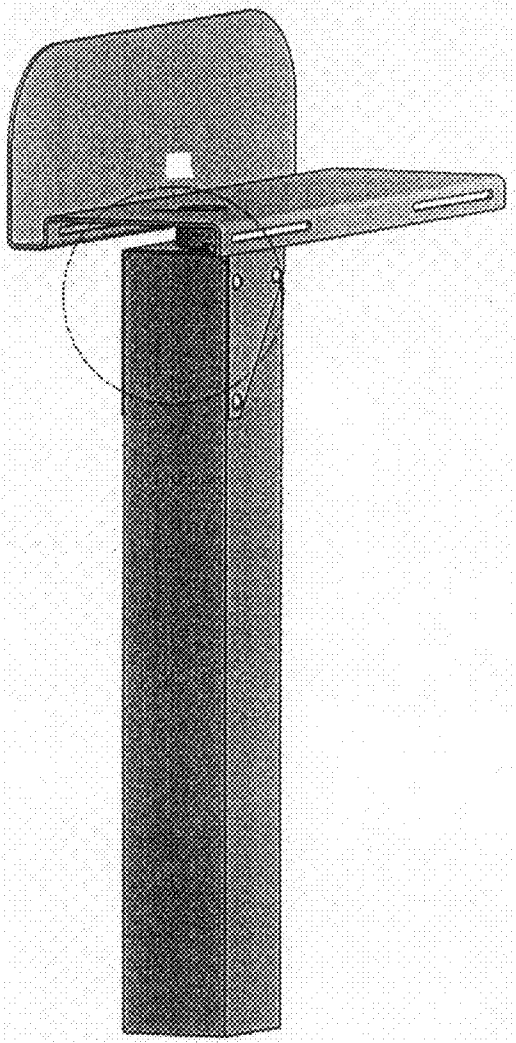
FIG. 8*c* shows a perspective view of the mailbox shown in FIG. 8*a* in an assembled state; where
Figure 8B:
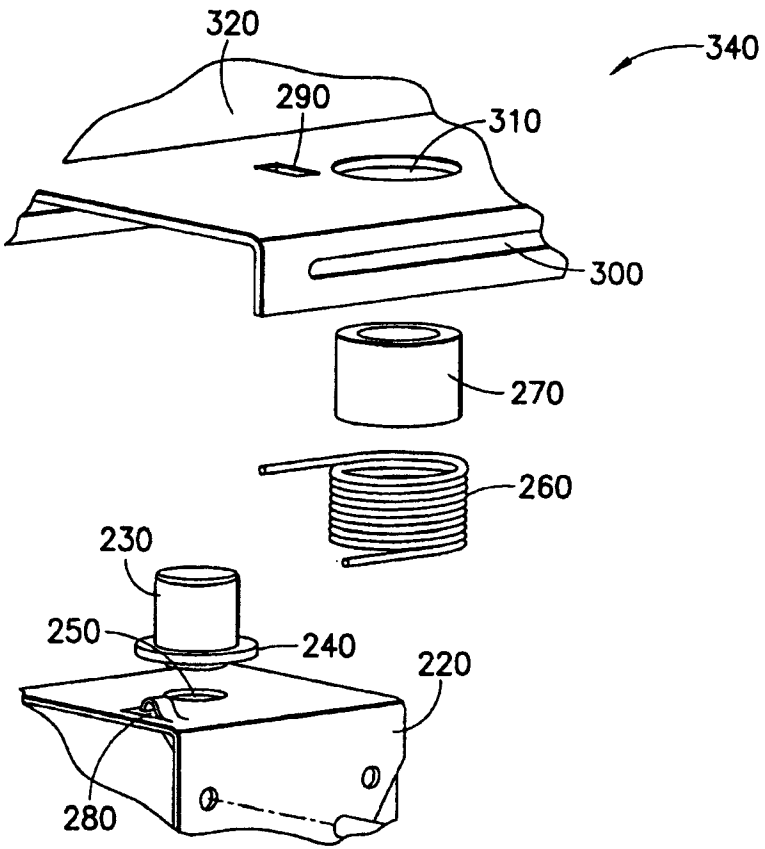
Figure 8A:
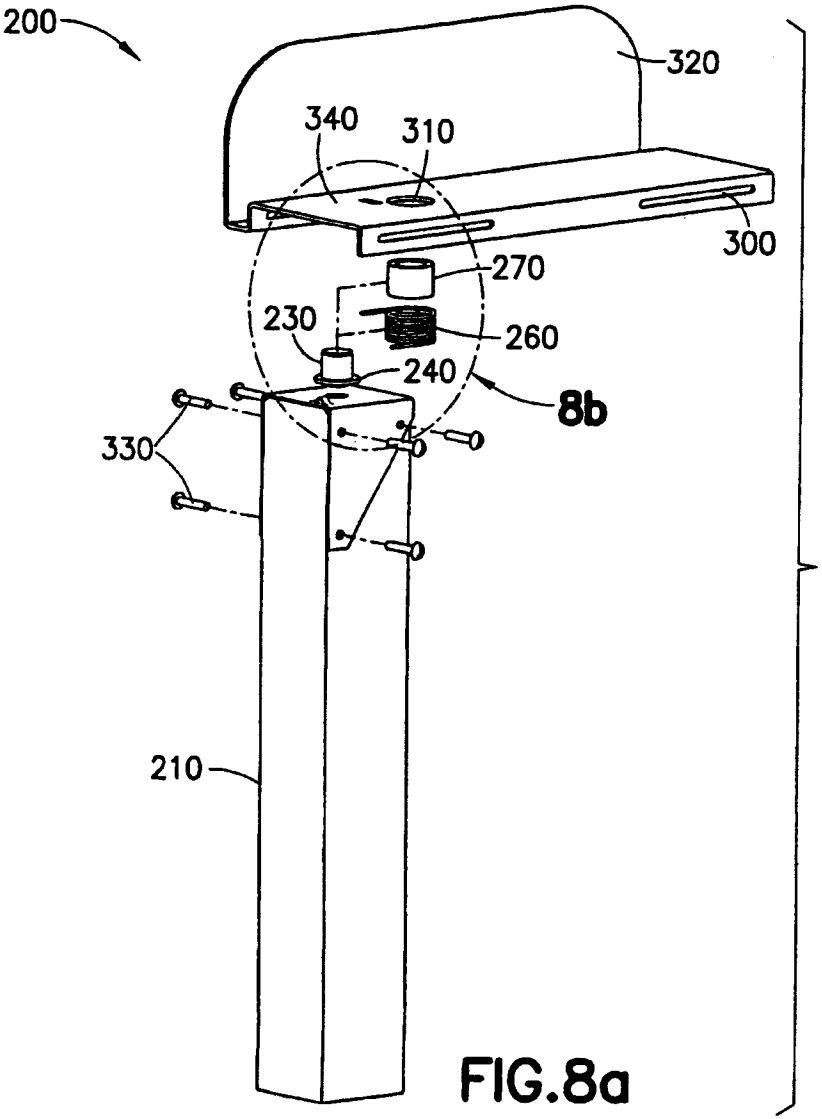
Figure 8D:
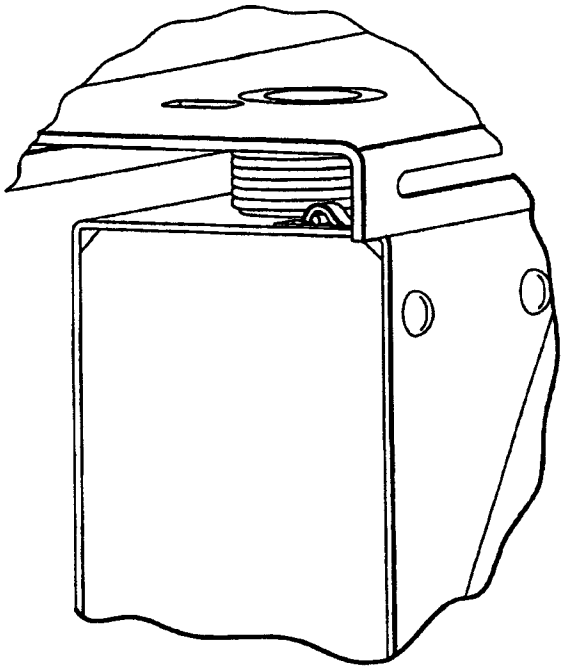
Figure 8C:
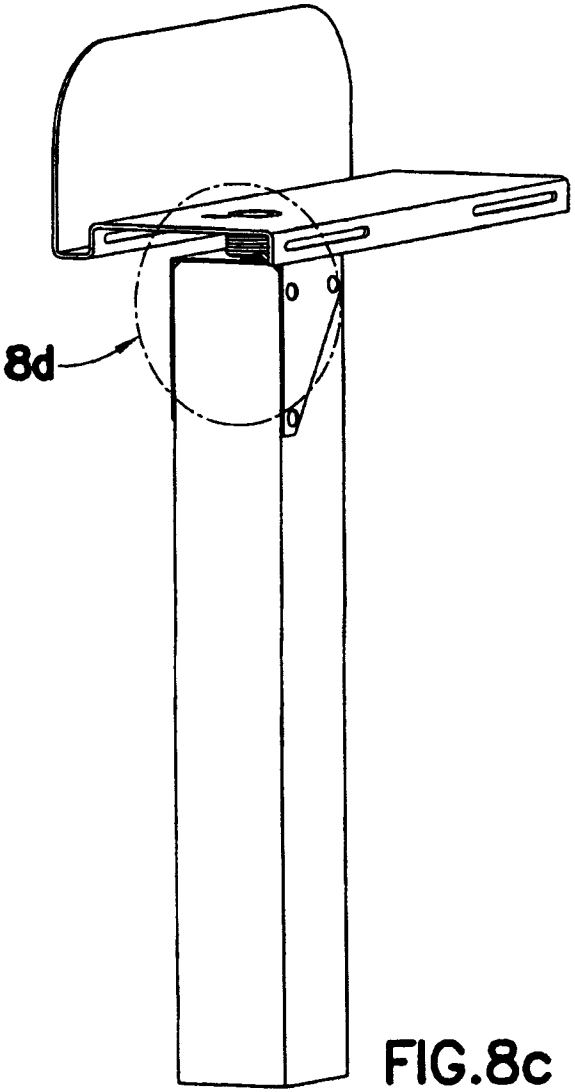

The mailbox arrangement of the present invention allows for a mailbox to be fixed on top of the steel mailbox mounting base/protection shield 320 by screws (not shown) in universal mailbox mounting slots 300. The assembled mailbox arrangement is shown in FIG. 8*c*, and in further detail in FIG. 8*d*.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein without departing from the spirit and scope of the present invention.

The invention claimed is:

1. A mailbox arrangement for mounting a mailbox to a mounting post, comprising:

a mailbox for receiving mail;

a mounting base coupled to the mailbox;

a mounting bracket for suitably coupling the mailbox arrangement to a mounting post; and a spring assembly for flexibly and rotationally coupling the mounting base to the mounting bracket in a predetermined relationship, wherein the spring assembly comprises:

a torsion spring;

a dowel pin for fixedly coupling to the mounting bracket; and a spacer for fixedly coupling to the mounting base and pivotally arranging on the dowel pin, wherein the torsion spring is arranged on the spacer and has one end coupled to a spring retainer in the mounting base and another end coupled to a corresponding spring retainer in the mounting bracket;

the spring assembly being responsive to a force, for pivoting the mounting base in relation to the mounting bracket in one direction so as to resist and absorb a torque being applied as a result of the force, and for pivoting the mounting base in relation to the mounting bracket in the opposite direction as a result of the torque being stored in the spring assembly so as to return the mounting base and the mounting bracket back to the predetermined relationship when the force is no longer applied, so that when the mailbox is mounted on the mounting post, the mailbox is oriented in a desired position for receiving mail, and so that when the mailbox receives an impact from snow, slush, ice or water thrown from a plowblade as a street is being cleaned in the winter time, or an alternative impact from a vandal striking the mailbox, the mailbox itself will return to the desired position for receiving mail when the impact is no longer applied.

2. A mailbox arrangement according to claim 1, wherein the dowel pin is welded to the mounting bracket; and the spacer is welded to the mounting base.

3. A mailbox arrangement according to claim 1, wherein the mounting base has mailbox mounting slots for mounting the mailbox.

4. A mailbox arrangement according to claim 1, wherein the mounting bracket has one or more apertures for receiving screws for affixing the mounting bracket to the mounting post.

5. A mailbox arrangement according to claim 1, wherein the mounting base has a protective shield for protecting the mailbox.

6. A mailbox arrangement according to claim 1, wherein the spring assembly comprises a thrust washer coupled to the dowel pin.

7. A mailbox mounting arrangement for mounting a mailbox to a mounting post, comprising:

a mounting base for coupling to the mailbox;

a mounting bracket for coupling to the mounting post; and a resilient assembly for flexibly and rotationally coupling the mounting base to the mounting bracket in a predetermined relationship, wherein the resilient assembly comprises:

a spring;

a dowel pin for fixedly coupling to the mounting bracket; and a spacer for fixedly coupling to the mounting base and pivotally arranging on the dowel pin, wherein the spring is arranged on the spacer and has one end coupled to a spring retainer in the mounting base and another end coupled to a corresponding spring retainer in the mounting bracket;

the resilient assembly being responsive to a force, for pivoting the mounting base in relation to the mounting bracket in one direction so as to resist and absorb a torque being applied as a result of the force, and for pivoting the mounting base in relation to the mounting bracket in the opposite direction as a result of the torque being stored in the resilient assembly so as to return the mounting base and the mounting bracket back to the predetermined relationship when the force is no longer applied, so that when the mailbox is mounted on the mounting post, the mailbox is oriented in a desired position for receiving mail, and so that when the mailbox receives an impact from snow, slush, ice or water thrown from a plowblade as a street is being cleaned in the winter time, or an alternative impact from a vandal striking the mailbox, the mailbox itself will return to the desired position for receiving mail when the impact is no longer applied.

8. A mailbox mounting arrangement according to claim 7, wherein the dowel pin is welded to the mounting bracket; and the spacer is welded to the mounting base.

9. A mailbox mounting arrangement according to claim 7, wherein the mounting base has mailbox mounting slots for mounting the mailbox.

10. A mailbox mounting arrangement according to claim 7, wherein the mounting bracket has one or more apertures for receiving screws for affixing the mounting bracket to the mounting post.

11. A mailbox mounting arrangement according to claim 7, wherein the mounting base has a protective shield for protecting the mailbox.

12. A mailbox mounting arrangement according to claim 7, wherein the resilient assembly comprises a thrust washer coupled to the dowel pin.

* * * * *

UNITED STATES PATENT AND TRADEMARK OFFICE

CERTIFICATE OF CORRECTION

PATENT NO. : 7,559,457 B2
APPLICATION NO. : 11/903357
DATED : July 14, 2009
INVENTOR(S) : Webber It is certified that error appears in the above-identified patent and that said Letters Patent is hereby corrected as shown below:

The title page showing an illustrative Figure should be deleted and substitute therefore the attached title page.

Delete drawing sheets 10 and 11 and substitute therefore the drawing sheets consisting of Fig 8a-8d as shown on the attached pages.

Signed and Sealed this

Sixteenth Day of March, 2010

David J. Kappos

David J. Kappos
*Director of the United States Patent and Trademark Office*

(12) United States Patent
Webber

(10) Patent No.: US 7,559,457 B2
(45) Date of Patent: Jul. 14, 2009

(54) MAILBOX ARRANGEMENT FOR WITHDRAWN IMPACTS FROM SNOW, SLUSH, ICE AND WATER THROWN FROM A PLOWBLADE

(75) Inventor: Michael Webber, 2 Chapel Hill Rd., Sherman, CT (US) 06784

(73) Assignee: Michael Webber, Sherman, CT (US)

( * ) Notice: Subject to any disclaimer, the term of this patent is extended or adjusted under 35 U.S.C. 154(b) by 0 days.

(21) Appl. No.: 11/903,357

(22) Filed: Sep. 20, 2007

(65) Prior Publication Data

US 2008/0149697 A1 Jun. 26, 2008

(51) Int. Cl.
*A47G 29/12* (2006.01)

(52) U.S. Cl. ..... 232/39; 248/131; 248/145; 248/417

(58) Field of Classification Search ..... 232/39; 248/131, 417, 125.7, 418, 145, 219.2; D99/32
See application file for complete search history.

(56) References Cited

U.S. PATENT DOCUMENTS

| | | | |
|---|---|---|---|
| 1,053,082 | A | 2/1913 | Yeakel |
| 1,273,696 | A | 7/1918 | Vanhoof |
| 2,522,983 | A | 9/1950 | Bergstrom |
| 2,605,073 | A | 7/1952 | Glenn |
| 2,683,013 | A | 7/1954 | Amundson |
| 3,243,104 | A | 3/1966 | Fillion |
| 3,407,997 | A | 10/1968 | Wood et al. |
| 3,899,150 | A | 8/1975 | Racquet |
| 4,113,213 | A | 9/1978 | Gay et al. |
| 4,130,239 | A | 12/1978 | Belsheim |
| 4,187,978 | A | 2/1980 | Dowker |
| 4,955,533 | A | 9/1990 | Merkel |
| 4,995,576 | A | 2/1991 | Kieswetter |
| 5,065,975 | A | 11/1991 | Giles |
| 5,215,283 | A | 6/1993 | Gould |
| 5,400,958 | A | 3/1995 | Walker |
| 5,437,409 | A | 8/1995 | Coushaine |
| 5,458,286 | A | 10/1995 | Paschal |
| 5,460,326 | A | 10/1995 | Albanesius |
| 5,524,853 | A | 6/1996 | Varlaro |
| 5,622,343 | A | 4/1997 | Morton |
| 5,699,989 | A | 12/1997 | Guthrie |

(Continued)

*Primary Examiner*—William L. Miller

(57) ABSTRACT

A mailbox arrangement is provided for mounting a mailbox to a mounting post, featuring a mailbox for receiving mail; a mounting base coupled to the mailbox; a mounting bracket for suitably coupling the mailbox arrangement to a mounting post; and a spring assembly for flexibly and rotationally coupling the mounting base to the mounting bracket in a predetermined relationship, the spring assembly being responsive to a force, for pivoting the mounting base in relation to the mounting bracket in one direction so as to resist and absorb a torque being applied as a result of the force, and for pivoting the mounting base in relation to the mounting bracket in the opposite direction as a result of the torque being stored in the spring assembly so as to return the mounting base and the mounting bracket back to the predetermined relationship when the force is no longer applied, so that when the mailbox is mounted on the mounting post, the mailbox is oriented in a desired position for receiving mail, and so that when the mailbox receives an impact from snow, slush, ice or water thrown from a plowblade as a street is being cleaned in the winter time, or an alternative impact from a vandal striking the mailbox, the mailbox itself will return to the desired position for receiving mail when the impact is no longer applied.

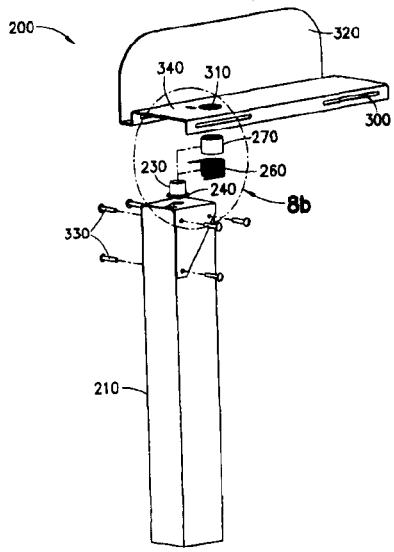

12 Claims, 11 Drawing Sheets